US012338502B2

(12) United States Patent
Novotny

(10) Patent No.: US 12,338,502 B2
(45) Date of Patent: Jun. 24, 2025

(54) ULTRA-HIGH STRENGTH ALLOY

(71) Applicant: CRS HOLDINGS, LLC, Wilmington, DE (US)

(72) Inventor: Paul M. Novotny, Mohnton, PA (US)

(73) Assignee: CRS HOLDINGS, LLC, Wilmington, DE (US)

( * ) Notice: Subject to any disclaimer, the term of this patent is extended or adjusted under 35 U.S.C. 154(b) by 0 days.

(21) Appl. No.: 18/484,657

(22) Filed: Oct. 11, 2023

(65) Prior Publication Data

US 2024/0271237 A1 Aug. 15, 2024

Related U.S. Application Data

(63) Continuation of application No. 16/857,413, filed on Apr. 24, 2020, now abandoned.

(60) Provisional application No. 62/839,189, filed on Apr. 26, 2019.

(51) Int. Cl.

| | |
|---|---|
| ***C22C 38/52*** | (2006.01) |
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/50*** | (2006.01) |

(52) U.S. Cl.

CPC ..... *C21D 6/008* (2013.01); *C21D 6/004* (2013.01); *C21D 6/005* (2013.01); *C21D 6/007* (2013.01); *C22C 38/002* (2013.01); *C22C 38/005* (2013.01); *C22C 38/02* (2013.01); *C22C 38/04* (2013.01); *C22C 38/06* (2013.01); *C22C 38/44* (2013.01); *C22C 38/50* (2013.01); *C22C 38/52* (2013.01)

(58) Field of Classification Search

CPC ..... C22C 38/005; C22C 38/44; C22C 38/52
USPC ..... 420/83
See application file for complete search history.

(56) References Cited

U.S. PATENT DOCUMENTS

| | | | |
|---|---|---|---|
| 4,076,525 A | 2/1978 | Little et al. | |
| 5,087,415 A | 2/1992 | Hemphill et al. | |
| 5,268,044 A | 12/1993 | Hemphill et al. | |
| 5,866,066 A | 2/1999 | Hemphill et al. | |
| 2007/0113931 A1* | 5/2007 | Novotny | C22C 38/44 148/333 |

FOREIGN PATENT DOCUMENTS

| | | |
|---|---|---|
| EP | 0390468 A1 | 3/1990 |
| WO | 9112352 | 8/1991 |
| WO | 9810112 | 3/1998 |
| WO | 9822024 | 5/1998 |

OTHER PUBLICATIONS

W.M. Garrison Jr. et al., "An Evaluation of an Ultra-High Strength Steel Strengthened by Alloy Carbide and Intermetallic Precipitates," Trans. Indian Inst. Met., vol. 49 No. 3, Jun. 1996, pp. 151-162.

M. Grujicic, "Thermodynamics Aided Design of High Co—Ni Secondary Hardening Steels," CALPHAD vol. 14 No. 1, 1990, pp. 49-59.

K.J. Handerhan et al., "A Comparison of the Fracture Behavior of Two Heats of the Secondary Hardening Steel AF1410," Metallurgical Transactions vol. 20A, Jan. 1989, pp. 105-123.

* cited by examiner

*Primary Examiner* — Katherine A Christy

(74) *Attorney, Agent, or Firm* — Niels Haun; Dann, Dorfman, Herrell & Skillman, P.C.

(57) ABSTRACT

A steel alloy having very high strength in combination with good ductility, impact toughness, and fracture toughness is disclosed. The alloy has the following weight percent composition.

| | |
|---|---|
| C | 0.30-0.46 |
| Mn | 0.04 max. |
| Si | 0.03 max. |
| P | 0.003 max. |
| S | 0.0010 max. |
| Cr | 1.65-2.90 |
| Ni | 10.5-13.0 |
| Mo | 1.2-3.4 |
| Co | 15.4-18.6 |
| Al | 0.01 max. |
| Ti | 0.02 max. |
| O | 0.0010 max. |
| N | 0.0010 max. |

The balance is iron and usual impurities.

3 Claims, No Drawings

ULTRA-HIGH STRENGTH ALLOY

CROSS REFERENCE TO RELATED APPLICATION

This application is a continuation of U.S. patent application Ser. No. 16/857,413, filed Apr. 24, 2020, which claims the benefit of U.S. Provisional Patent Application No. 62/839,189, filed Apr. 26, 2019, the entireties of which are incorporated herein by reference.

FIELD OF THE INVENTION

The present invention relates to an age hardenable, martensitic steel alloy, and in particular, to such an alloy which provides very high tensile strength in combination with acceptable levels of ductility and toughness.

BACKGROUND OF THE INVENTION

Certain applications require the use of an alloy having a combination of very high strength and acceptable levels of toughness and ductility. For example, projectiles used in military artillery require very high strength and hardness to provide the ability to penetrate an armored target. Another example is in ballistic tolerant applications that utilize multi-layer applique armor. Such applications require an outer alloy layer with very high strength to shatter a projectile on impact. The projectile fragments are caught by a lower strength, higher toughness inner alloy layer.

Other possible uses for such very high strength alloys include structural components for aircraft, such as landing gear and main shafts of jet engines. Such alloys permit aerospace designers to reduce the size and weight of such components. Another useful application for such alloys is in tooling components for the machining of steel and other metals.

In view of the foregoing background information, a need has arisen for an alloy having an even higher strength than the known alloys to provide improved ballistic performance and stronger structural components. It is known that ductility and toughness are inversely related to the ultimate tensile strength. Therefore, the alloy should also provide acceptable toughness and ductility for adequate reliability in components and to permit non-destructive inspection of structural components for flaws which can otherwise result in catastrophic failure.

SUMMARY OF THE INVENTION

The alloy according to the present invention is an age hardenable martensitic steel that provides significantly higher strength than known alloys while maintaining acceptable levels of ductility and toughness relative to the known alloys. In particular, the alloy of the present invention is capable of providing an ultimate tensile strength (UTS) of at least about 360 ksi in combination acceptable toughness and ductility. Acceptable toughness is defined as a room temperature Charpy V-notch impact energy of at least about 5 ft-lbs in the longitudinal direction. Acceptable ductility is defined as a tensile elongation of at least about 7% and tensile reduction in area of at least about 30%. The alloy of the present invention is also capable of providing a UTS of up to about 390 ksi in the longitudinal direction.

The broad and preferred compositional ranges of the age-hardenable, martensitic steel of the present invention are as follows, in weight percent:

| | Broad | Preferred A | Preferred B |
|---|---|---|---|
| C | 0.30-0.46 | 0.30-0.46 | 0.35-0.46 |
| Mn | 0.04 max. | 0.04 max. | 0.04 max. |
| Si | 0.03 max. | 0.03 max. | 0.03 max. |
| P | 0.003 max. | 0.003 max. | 0.003 max. |
| S | 0.0010 max. | 0.0010 max. | 0.0010 max. |
| Cr | 1.65-2.90 | 1.65-2.90 | 1.65-2.90 |
| Ni | 10.5-13.0 | 10.5-13.0 | 10.5-13.0 |
| Mo | 1.2-3.4 | 1.8-3.4 | 1.2-3.4 |
| Co | 15.4-18.6 | 15.4-18.6 | 15.4-18.6 |
| Al | 0.01 max. | 0.005 max. | 0.003 max. |
| Ti | 0.02 max. | 0.015 max. | 0.015 max. |
| O | 0.0010 max. | 0.0010 max. | 0.0010 max. |
| N | 0.0010 max. | 0.0010 max. | 0.0010 max. |

In one embodiment, the alloy contains an effective amount of cerium and/or an effective amount of lanthanum. An effective amount of cerium is present in the alloy when the ratio of cerium to sulfur (Ce/S) is at least about 4 and not more than about 20 after primary melting.

An effective amount of lanthanum is present in the alloy when the ratio of lanthanum to sulfur (La/S) is at least about 4 and not more than about 20 after primary melting.

In another embodiment, a small but effective amount of calcium and/or other sulfur-gettering element is present in the alloy in place of some or all of the cerium and lanthanum. For best results, at least about 10 ppm calcium or sulfur-gettering element other than calcium is present in the alloy after primary melting.

The alloy of the present invention is critically balanced to provide a superior combination of strength, ductility, impact toughness, and fracture toughness compared to the known alloys. To that end, carbon and cobalt are balanced so that the ratio Co/C is at least about 43, preferably at least about 52, and not more than about 100, preferably not more than about 75.

The foregoing tabulation is provided as a convenient summary and is not intended thereby to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in a preferred composition. In addition, a minimum or maximum for an element of one preferred embodiment can be used with the maximum or minimum for that element from another preferred embodiment. Here and throughout this application, unless otherwise indicated, the term percent or the symbol % means percent by weight or mass.

DETAILED DESCRIPTION OF THE PREFERRED EMBODIMENTS

The alloy according to the present invention contains at least about 0.30% or at least about 0.32% carbon. Carbon contributes to the good strength and hardness capability of the alloy primarily by combining with other elements, such as chromium and molybdenum, to form $M_2C$ carbides during an age hardening heat treatment. When higher strength and or hardness is desired, the alloy contains at least about 0.35% or at least about 0.38% carbon. Too much carbon adversely affects the room temperature Charpy V-notch (CVN) impact toughness and the ductility provided by the alloy. Therefore, carbon is limited to not more than about 0.46% and preferably to not more than about 0.42%. In some embodiments, carbon is restricted to not more than about 0.40% in this alloy.

Cobalt contributes to the very high tensile strength provided by this alloy and benefits the age-hardenability of the alloy by promoting heterogeneous nucleation sites for the $M_2C$ carbides. In addition, it is believed that the presence of cobalt to promote strength is less detrimental to the toughness of the alloy than the addition of carbon. For these reasons, the alloy contains at least about 15.4% cobalt. For applications requiring a particularly high strength alloy, at least about 16.0% cobalt may be present in the alloy. Because cobalt is an expensive element, the benefit obtained from cobalt does not justify using unlimited amounts of it in this alloy. Therefore, cobalt is restricted to not more than about 18.6% and preferably to not more than about 18.0% in this alloy.

Carbon and cobalt may be controlled in the alloy of the present invention to benefit the superior combination of very high strength, toughness, and ductility. It is believed that increasing the ratio of cobalt to carbon (Co/C) benefits the toughness provided by the alloy and may result in a better combination of strength and toughness in this alloy. Further, increasing the Co/C ratio benefits the notch toughness of the alloy. Accordingly, cobalt and carbon may be controlled in the present alloy such that the ratio Co/C is at least about 38. However, the benefits from a high Co/C ratio are offset by the high cost of producing an alloy having a Co/C ratio that is too high. Therefore, the Co/C ratio is restricted to not more than about 55.

Chromium contributes to the very high strength and hardness capability of this alloy by combining with carbon to form $M_2C$ carbides during the age-hardening process. Accordingly, at least about 1.65% and preferably at least about 1.7% or 1.8% chromium is present in the alloy. Too much chromium increases the sensitivity of the alloy to overaging and results in increased precipitation of carbides at the grain boundaries, which adversely affects the alloy's toughness and ductility. Accordingly, chromium is limited to not more than about 2.9% or 2.8%, and preferably to not more than about 2.5% in this alloy. In some embodiments of this alloy, chromium is restricted to not more than about 2.0%.

Molybdenum, like chromium, is present in this alloy because it contributes to the good strength and hardness capability of the alloy by combining with carbon to form $M_2C$ carbides during the aging process. Additionally, molybdenum reduces the sensitivity of the alloy to overaging during heat treatment. Therefore, at least about 1.2% and preferably at least about 1.3% molybdenum is present in the alloy. When higher strength is needed, the alloy may contain at least about 1.8% molybdenum and preferably at least about 2.2% molybdenum. Too much molybdenum increases the risk of undesirable grain boundary carbide precipitation, which would result in reduced toughness and ductility. Therefore, molybdenum is restricted to not more than about 3.4% and preferably to not more than about 2.4%. In another embodiment of the alloy, molybdenum is restricted to not more than about 1.9%.

At least about 10.5% and preferably at least about 11% nickel is present in the alloy because nickel benefits the hardenability of the alloy and reduces the alloy's sensitivity to quenching rate, such that acceptable CVN toughness is readily obtainable. However, too much nickel promotes an increased sensitivity to overaging by the alloy during heat treatment. Accordingly, nickel is restricted in the alloy to not more than about 13% and preferably to not more than about 12% in this alloy.

Other elements can be present in the alloy in amounts that do not detract from the desired combination of properties provided by this alloy. In particular, not more than about 0.04% manganese may be present in the alloy because manganese adversely affects the toughness provided by the alloy. Not more than about 0.03% silicon, not more than about 0.01% aluminum, and not more than about 0.02% titanium may be present as residuals from small deoxidation additions during melting.

Small but effective amounts of elements that provide sulfide shape control are present in the alloy to benefit the toughness by combining with sulfur to form sulfide inclusions that do not adversely affect the fracture toughness property. In one embodiment of the present invention, the alloy contains amounts of cerium and lanthanum that are effective to provide the desired control of sulfide shape. In a preferred embodiment, cerium and lanthanum are included in the alloy through an addition of mischmetal during primary melting. The amount of mischmetal added is selected to recover the effective amounts of cerium and lanthanum in the as-cast alloy after secondary melting. An effective amount of cerium is present in the alloy when the ratio of cerium to sulfur (Ce/S) is at least about 4 and not more than about 20 after primary melting. If the Ce/S ratio is more than about 20, the hot workability and tensile ductility of the alloy are adversely affected. Preferably, the Ce/S ratio is at least about 8, but not more than about 10. When the alloy is double vacuum melted, the Ce/S ratio after secondary melting should be about 2-10.

To ensure good hot workability, for example, when the alloy is to be press forged as opposed to rotary forged, the alloy contains not more than about 0.01% cerium and not more than about 0.005% lanthanum. The alloy contains not more than about 0.015% lanthanum after secondary melting when pure lanthanum is used to desulfurize the alloy.

In another embodiment, pure lanthanum can be added in an amount sufficient to provide a recovered amount of up to 0.040% lanthanum after secondary melting to provide desulfurization and sulfide shape control of the alloy. An effective amount of lanthanum is present in the alloy when the ratio of lanthanum to sulfur (La/S) is at least about 4, but not more than about 20 after primary melting. If the La/S ratio is more than about 20, the hot workability and tensile ductility of the alloy may be adversely affected. Preferably, the La/S ratio is not more than about 10. When the alloy is double melted, the La/S ratio after secondary melting should be about 2-10.

In a further embodiment of this alloy, a small but effective amount of calcium and/or other sulfur-gettering element, such as magnesium or yttrium, is present in the alloy in place of some or all of the cerium and/or lanthanum to provide the beneficial sulfide shape control.

The balance of the alloy is essentially iron except for the usual impurities found in commercial grades of alloys intended for similar service or use. The levels of such elements are controlled to avoid adversely affecting the desired combination of strength, ductility, and toughness. In particular, phosphorous is restricted to not more than about 0.003% because of its embrittling effect on the alloy. Sulfur, although inevitably present, is restricted to not more than about 0.0010%, because sulfur adversely affects the toughness provided by the alloy. Oxygen is restricted to not more than about 0.0010% and preferably is kept as low as possible. Similarly, nitrogen is restricted to not more than about 0.0010% and is also preferably kept as low as possible in the alloy.

Within the foregoing weight percent ranges, the elements can be balanced to provide different levels of tensile strength. Thus, for example, an alloy composition containing about 0.38-0.42% C, 0.04% max. Mn, 0.03% max. Si, 1.8-2.5% Cr, 11.0-13.0% Ni, 1.3-1.9% Mo, 15.4-18.6% Co, and the balance essentially Fe and impurities, has been found to provide a tensile strength of about 360-370 ksi in combination with acceptable ductility and toughness after being austenitized and age hardened as described in this specification. An alloy composition containing about 0.32-0.46% C, 0.04% max. Mn, 0.03% max. Si, 1.8-2.8% Cr, 11.0-12.0% Ni, 1.3-2.4% Mo, 15.4-18.6% Co, and the balance essentially Fe and impurities, has been found to provide a tensile strength of about 370-380 ksi in combination with acceptable ductility and toughness when austenitized and age hardened as described in this specification. Further, an alloy composition containing about 0.32-0.40% C, 0.04% max. Mn, 0.03% max. Si, 1.7-2.0% Cr, 10.5-12.0% Ni, 2.2-2.4% Mo, 16.0-18.0% Co, and the balance essentially Fe, has been found to provide a tensile strength of about 380-390 ksi in combination with acceptable toughness and ductility when austenitized and age hardened as described in this specification.

The alloy of the present invention is readily melted using conventional vacuum melting techniques. For best results, a double vacuum melting practice is preferred. The preferred practice is to melt a heat in a vacuum induction furnace (VIM) (primary melting) and cast the heat in the form of an electrode. The alloying addition for sulfide shape control referred to above is preferably made before the molten VIM heat is cast. After solidification, the electrode is vacuum arc remelted (VAR) (secondary melting) and recast into one or more ingots. Prior to VAR, the electrode ingot is preferably stress relieved at about 1250° F. for 4-16 hours and air cooled. After VAR, the ingot is preferably homogenized at about 2150°-2250° F. for 6-24 hours.

The alloy can be hot worked from a starting temperature of about 2250° F. down to about 1500° F. The preferred hot working practice is to forge an ingot from about 2150°-2250° F. to obtain at least about a 30% reduction in cross-sectional area. The ingot is then reheated to about 1800° F. and further forged to obtain at least about another 30% reduction in cross-sectional area.

Heat treating to obtain the desired combination of properties proceeds as follows. The alloy is austenitized by heating it at about 1550° F.-1900° F. for about 1 hour plus about 5 minutes per inch of thickness and then quenching. The quench rate is preferably rapid enough to cool the alloy from the austenizing temperature to about 150° F. in not more than about 2 hours. The preferred quenching technique will depend on the cross-section of the manufactured part. However, the hardenability of this alloy is good enough to permit air cooling, vermiculite cooling, or inert gas quenching in a vacuum furnace, as well as oil quenching. As an alternative, good results have been obtained when the alloy is austenitized using a two-step process in which the alloy is first heated at about 1850-1900° F. for the time described above, cooled to room temperature, and then heated at about 1750-1850° F. for a similar time and then air cooled. After the austenitizing treatment, the alloy is preferably cold treated as by deep chilling at about −100° F. for about 0.5-1 hour and then warmed in air.

Age hardening of this alloy is preferably conducted by heating the alloy at about 850°-950° F. for up to about 8 hours, preferably at least about 6 or 7 hours, followed by cooling in air. To maximize the strength and toughness properties provided by the alloy a double aging technique can be used. For example, instead of using a single aging treatment, the aging treatment can be performed with two, separate aging treatments at the aging temperature described above for about 3.5 to 4 hours each. When the two-step aging treatment is used, the alloy is deep chilled as described above after the first aging step. The cold treatment step between aging steps ensures maximum transformation of any reverted austenite to martensite. If desired, a second cold treatment step can be performed after the second aging step.

The alloy of the present invention is useful in a wide range of applications. The very high strength and good fracture toughness of the alloy makes it useful for ballistic tolerant applications. In addition, the alloy is suitable for other uses such as structural components for aircraft and machine tooling components.

WORKING EXAMPLES

Example 1

In order to demonstrate the novel combination of properties provided by the alloy according to this invention, a 400-lb heat was double vacuum melted (VIM/VAR) to an ingot. The weight percent composition of the VAR ingot is set forth in Table 1 below.

TABLE 1

| Elmt. | Example 1 |
|---|---|
| C | 0.34 |
| Mn | <0.01 |
| Si | 0.03 |
| P | <0.005 |
| S | 0.0008 |
| Cr | 1.77 |
| Ni | 11.46 |
| Mo | 2.37 |
| Co | 17.14 |
| Al | <0.001 |
| Ti | 0.017 |
| O | 0.0010 |
| N | <0.0010 |
| Ce | <0.001 |
| La | <0.001 |
| Ca | <0.005 |
| Co/C | 50.4 |

The balance of the composition was iron and the usual impurities.

The VAR ingot was hot worked to billet, 1.5 in. by 4.5 in. in cross section. Triplicate longitudinal tensile specimens, longitudinal specimens for Charpy V-notch testing, and longitudinal compact tension specimens for fracture toughness testing were prepared from the billet material. Duplicate transverse tensile specimens, duplicate transverse Charpy V-notch specimens, and triplicate transverse compact tension specimens for fracture toughness testing were also prepared from the billet material. The test specimens were heat treated as follows prior to testing.

- Normalize for 1 hour at 1875° F. and then air cooled to room temperature;
- Austenitize at 1775° F. for 1 hour followed by cooling in air;
- Deep chill at −100° F. for 1 hour and then warm in air;
- Age at 900° F. for 2.5 hours and then air cool;
- Deep chill at −100° F. for 1 hour and air warm;
- Age at 900° F. for 2.5 hours, air cool, and then
- Deep chill at −100° F. for 1 hour and warmed in air to room temperature.

The results of room temperature testing are presented in Table 2 below including the 0.2% offset yield strength (YS)

and the ultimate tensile strength (UTS) in ksi, the percent elongation (% El.). the percent reduction in area (% RA), the Charpy V-notch impact energy (CVN) in foot-pounds, and the $K_{Ic}$ fracture toughness in ksi√in.

TABLE 2

| Orientation | Sample No. | YS | UTS | % El. | % RA | CVN | $K_{Ic}$ |
|---|---|---|---|---|---|---|---|
| Longitudinal | 1 | 322 | 368 | 8.3 | 36.0 | 4.6 | 20.1 |
| | 2 | 326 | 370 | 7.9 | 30.8 | 4.3 | 20.4 |
| | 3 | 325 | 369 | 9.1 | 35.6 | 4.8 | 20.7 |
| | Avg. | 324 | 369 | 8.4 | 34.1 | 4.6 | 20.4 |
| Transverse | 1 | 322 | 368 | 7.8 | 30.8 | 5.1 | 20.0 |
| | 2 | 326 | 368 | 8.5 | 34.7 | 4.5 | 20.2 |
| | 3 | — | — | — | — | — | 19.8 |
| | Avg | 324 | 368 | 8.2 | 32.7 | 4.8 | 20.0 |

Example 2

As a further demonstration of the alloy according to the present invention, a full production size heat (about 10,000 lbs.) was double vacuum melted. The VAR ingot had the weight percent composition shown in Table 3 below.

TABLE 3

| Elmt. | Example 2 |
|---|---|
| C | 0.322 |
| Mn | 0.01 |
| Si | 0.03 |
| P | 0.002 |
| S | <0.005 |
| Cr | 1.81 |
| Ni | 10.98 |
| Mo | 2.38 |
| Co | 16.93 |
| Al | 0.006 |
| Ti | 0.01 |
| O | <0.0010 |
| N | <0.0010 |
| La | 0.010 |
| La/S | 20 |
| Co/C | 52.6 |

The balance of the composition was iron and the usual impurities.

The VAR ingot was hot worked to 13-inch diameter billet. Two sets of duplicate longitudinal tensile specimens and longitudinal specimens for Charpy V-notch testing were prepared from the billet material. The first set of the test specimens were heat treated as follows prior to testing.

Normalize for 1 hour at 1875° F. and then air cool to room temperature;

Austenitize at 1775° F. for 1 hour followed by cooling in air;

Deep chill at −100° F. for 1 hour and warm in air;

Age at 900° F. for 3.5 hours, then air cool;

Deep chill at −100° F. for 1 hour and air warm;

Age at 900° F. for 3.5 hours, air cool, and then

Deep chill at −100° F. for 1 hour and warm in air to room temperature.

The second set of test specimens were heat treated as follows prior to testing.

Normalize for 1 hour at 1875° F. and then air cool to room temperature;

Austenitize at 1775° F. for 1 hour followed by cooling in air;

Deep chill at −100° F. for 1 hour and warm in air;

Aged at 900° F. for 4 hours, then air cool;

Deep chill at −100° F. for 1 hour and air warm;

Age at 900° F. for 4 hours, air cool, and then

Deep chilled at −100° F. for 1 hour and then warm in air to room temperature.

The results of room temperature testing are presented in Table 4 below including the 0.2% offset yield strength (YS) and the ultimate tensile strength (UTS) in ksi, the percent elongation (% El.). the percent reduction in area (% RA), and the Charpy V-notch impact energy (CVN) in foot-pounds.

TABLE 4

| Set | Sample No. | YS | UTS | % El. | % RA | CVN |
|---|---|---|---|---|---|---|
| 1 | 1 | 324.9 | 366.7 | 6.0 | 23.0 | 4.3 |
| | 2 | 326.4 | 367.1 | 8.0 | 21.0 | 4.6 |
| | Avg. | 325.7 | 366.9 | 7.0 | 22.0 | 4.5 |
| 2 | 1 | 322.6 | 362.6 | 7.0 | 29.0 | 4.9 |
| | 2 | 322.2 | 363.4 | 8.0 | 16.0 | 4.7 |
| | Avg | 322.4 | 363.0 | 7.5 | 22.5 | 4.8 |

The terms and expressions which are employed in this specification are used as terms of description and not of limitation. There is no intention in the use of such terms and expressions of excluding any equivalents of the features shown and described or portions thereof. It is recognized that various modifications are possible within the invention described and claimed herein.

The invention claimed is:

1. A steel alloy consisting essentially of, in weight percent:

| | |
|---|---|
| C | 0.32-0.40 |
| Mn | 0.04 max. |
| Si | not more than about 0.03 |
| P | 0.003 max. |
| S | 0.0010 max. |
| Cr | 1.7 to not more than about 2.0 |
| Ni | 10.5-13 |
| Mo | 2.2-2.4 |
| Co | 16-18 |
| Al | 0.01 max. |
| Ti | 0.02 max. |
| O | 0.0010 max. |
| N | 0.0010 max. |

one or both of Ce up to 0.01% and La up to 0.04%, wherein the ratio Ce/S or La/S is 4 to 20; and the balance of the alloy is iron and usual impurities.

2. The steel alloy as claimed in claim 1, wherein nickel is 11 to 13%.

3. The steel alloy as claimed in claim 2, wherein nickel is 11 to 12%.

* * * * *